US005615446A

United States Patent [19]

Cetnarowski

[11] Patent Number: 5,615,446

[45] Date of Patent: Apr. 1, 1997

[54] DECK MOP WRINGER WITH ADJUSTABLE SUPPORT STANDS

[76] Inventor: Charles E. Cetnarowski, 26 Hillcrest Ave., Ossining, N.Y. 10562

[21] Appl. No.: 511,782

[22] Filed: Aug. 7, 1995

[51] Int. Cl.[6] ..... A47L 13/58

[52] U.S. Cl. ..... 15/261; 100/131; 68/241

[58] Field of Search ..... 15/260, 261, 262, 15/263; 100/125, 131, 132, 133; D32/27, 54; 68/241

[56] References Cited

U.S. PATENT DOCUMENTS

| | | | |
|---|---|---|---|
| 960,371 | 6/1910 | Monahan | 15/261 |
| 1,085,346 | 1/1914 | Lawlor | 15/262 |
| 1,140,989 | 5/1915 | Kurtz | 15/262 |
| 4,720,879 | 1/1988 | Rabban | 15/262 |

FOREIGN PATENT DOCUMENTS

| | | | |
|---|---|---|---|
| 105 | 1/1881 | United Kingdom | 15/261 |

*Primary Examiner*—Gary K. Graham

[57] ABSTRACT

A deck mop wringer with adjustable support stands comprising a rear support stand including a base member and at least one vertically positioned shaft. Each shaft is adjustable to a plurality of different heights. A front support stand includes a base member and at least one vertically positioned shaft. Each shaft is adjustable to a plurality of different heights. A wringer device comprises a basket and a rim. The basket has an open top, a floor and a plurality of side walls including apertures. The rim extends around the open top of the basket. The shafts of the front and rear support stands are coupled to the rim to support the basket in a suspended orientation. A wringer plate assembly includes a perforated front plate and a handle. The plate is rotatably coupled within the basket and positioned in an essentially vertical orientation. The handle is pulled by the user to ring a mop head positioned within the basket.

7 Claims, 4 Drawing Sheets

DECK MOP WRINGER WITH ADJUSTABLE SUPPORT STANDS

BACKGROUND OF THE INVENTION

1. Field of the Invention

The present invention relates to a deck mop wringer with adjustable support stands and more particularly pertains to wringing mop heads with minimal fluid spillage by positioning one's foot on a support stand base while utilizing the apparatus.

2. Description of the Prior Art

The use of mop wringer devices is known in the prior art. More specifically, mop wringer devices heretofore devised and utilized for the purpose of wringing mops by utilizing the devices in the suggested manner are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. Des. 255,976 to Maza a downward pressure mop wringer.

U.S. Pat. No. Des. 250,507 to Raftery discloses a mop wringer.

U.S. Pat. No. 3,921,247 to Cook discloses a mop wringer attachment for a bucket.

U.S. Pat. No. 3,497,901 to Shipp discloses a mop and wringer assembly.

Lastly, U.S. Pat. No. 5,333,353 to Taylor discloses mop wringers and buckets.

In this respect, the deck mop wringer with adjustable support stands according to the present invention substantially departs from the conventional concepts and designs of the prior art, and in doing so provides an apparatus primarily developed for the purpose of wringing mop heads with minimal fluid spillage by positioning one's foot on a support stand base while utilizing the apparatus.

Therefore, it can be appreciated that there exists a continuing need for a new and improved deck mop wringer with adjustable support stands which can be used for wringing mop heads with minimal fluid spillage by positioning one's foot on a support stand base while utilizing the apparatus. In this regard, the present invention substantially fulfills this need.

SUMMARY OF THE INVENTION

In view of the foregoing disadvantages inherent in the known types of mop wringer devices now present in the prior art, the present invention provides an improved deck mop wringer with adjustable support stands. As such, the general purpose of the present invention, which will be described subsequently in greater detail, is to provide a new and improved deck mop wringer with adjustable support stands and method which has all the advantages of the prior art and none of the disadvantages.

To attain this, the present invention essentially comprises a new and improved deck mop wringer with adjustable support stands comprising, in combination, a pail formed in a generally cylindrical configuration with an open top. The pail includes cleaning fluid in an operative orientation. A rear support stand includes a circular base member. The circular base member is positioned horizontally and includes a plurality of apertures. A receiving post is formed in a cylindrical configuration with an upper extent including an axial bore and a radial aperture. The post is affixed vertically to the perimeter of the base member. An adjustable shaft is formed in a cylindrical configuration and includes a lower end with a plurality of radial apertures. The lower end is positionable in the bore of the receiving post. A pin includes locking means securing the adjustable shaft within the receiving post at the desired vertical height. A front support stand includes a rectangular base member. The base member is positioned horizontally with two rear corners and two front corners. Two receiving posts are formed in a cylindrical configuration with an upper end include an axial bore and a radial aperture. The posts are affixed vertically to the rear corners of the base. Two adjustable shafts are formed in a cylindrical configuration with a lower end including a plurality of radial apertures. Each lower end is positionable in the bore of a receiving post. A pin includes locking means securing each adjustable shaft within a receiving post at the desired vertical height. A wringer device comprises a basket and a rim. The basket is formed as a rectangular box having a front wall, a rear wall, two side walls, a floor and an open top. The front and rear walls include a plurality of apertures and is angled outwardly from the floor to the open top. Hinges are positioned in the front corners of the basket adjacent to its floor. A rim with frontwardly and rearwardly projecting ledges is positioned horizontally around the open top of the basket. The adjustable shaft of the rear support stand is affixed to the rearwardly projecting ledge. The adjustable shaft of the front support stand is affixed to the frontwardly projecting ledge. The rear support stand and basket are positionable in the pail. A wringer plate assembly includes a generally L-shaped rear plate with a long vertical member and a short horizontal member. Each member is formed in a planar rectangular configuration. The horizontal member includes a free edge which has rotatable coupling means and is coupled within the hinges of the bucket. The vertical member has an upper extent including a cylindrical cross member and a plurality of apertures. A perforated front plate is formed in a planar rectangular configuration and extends from the cylindrical cross member to the approximate centerpoint of the horizontal member. A handle is formed in a generally L-shaped configuration with a free end pivotally coupled to the cylindrical cross member. Two spring base units with resilient springs extend therefrom and are affixed to the front wall of the basket. The springs are coupled to the front plate. A user pulls the handle to squeeze fluid from a mop positioned in the basket.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved deck mop wringer with adjustable support stands which has all of the advantages of the prior art mop wringer devices and none of the disadvantages.

It is another object of the present invention to provide a new and improved deck mop wringer with adjustable support stands which may be easily and efficiently manufactured and marketed.

It is further object of the present invention to provide a new and improved deck mop wringer with adjustable support stands which is of durable and reliable constructions.

An even further object of the present invention is to provide a new and improved deck mop wringer with adjustable support stands which is susceptible of a low cost of manufacture with regard to both materials and labor, and which accordingly is then susceptible of low prices of sale to the consuming public, thereby making such deck mop wringer with adjustable support stands economically available to the buying public.

Still yet another object of the present invention is to provide a new and improved deck mop wringer with adjustable support stands which provides in the apparatuses and methods of the prior art some of the advantages thereof, while simultaneously overcoming some of the disadvantages normally associated therewith.

Still another object of the present invention is to wring mop heads with minimal fluid spillage by positioning one's foot on a support stand base while utilizing the apparatus.

Lastly, it is an object of the present invention to provide a deck mop wringer with adjustable support stands comprising a rear support stand including a base member and at least one vertically positioned shaft. Each shaft is adjustable to a plurality of different heights. A front support stand includes a base member and at least one vertically positioned shaft. Each shaft is adjustable to a plurality of different heights. A wringer device comprises a basket and a rim. The basket has an open top, a floor and a plurality of side walls including apertures. The rim extends around the open top of the basket. The shafts of the front and rear support stands are coupled to the rim to support the basket in a suspended orientation. A wringer plate assembly includes a perforated front plate and a handle. The plate is rotatably coupled within the basket and positioned in an essentially vertical orientation. The handle is pulled by the user to ring a mop head positioned within the basket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various FIGS.

DESCRIPTION OF THE PREFERRED EMBODIMENT

Figure 1:
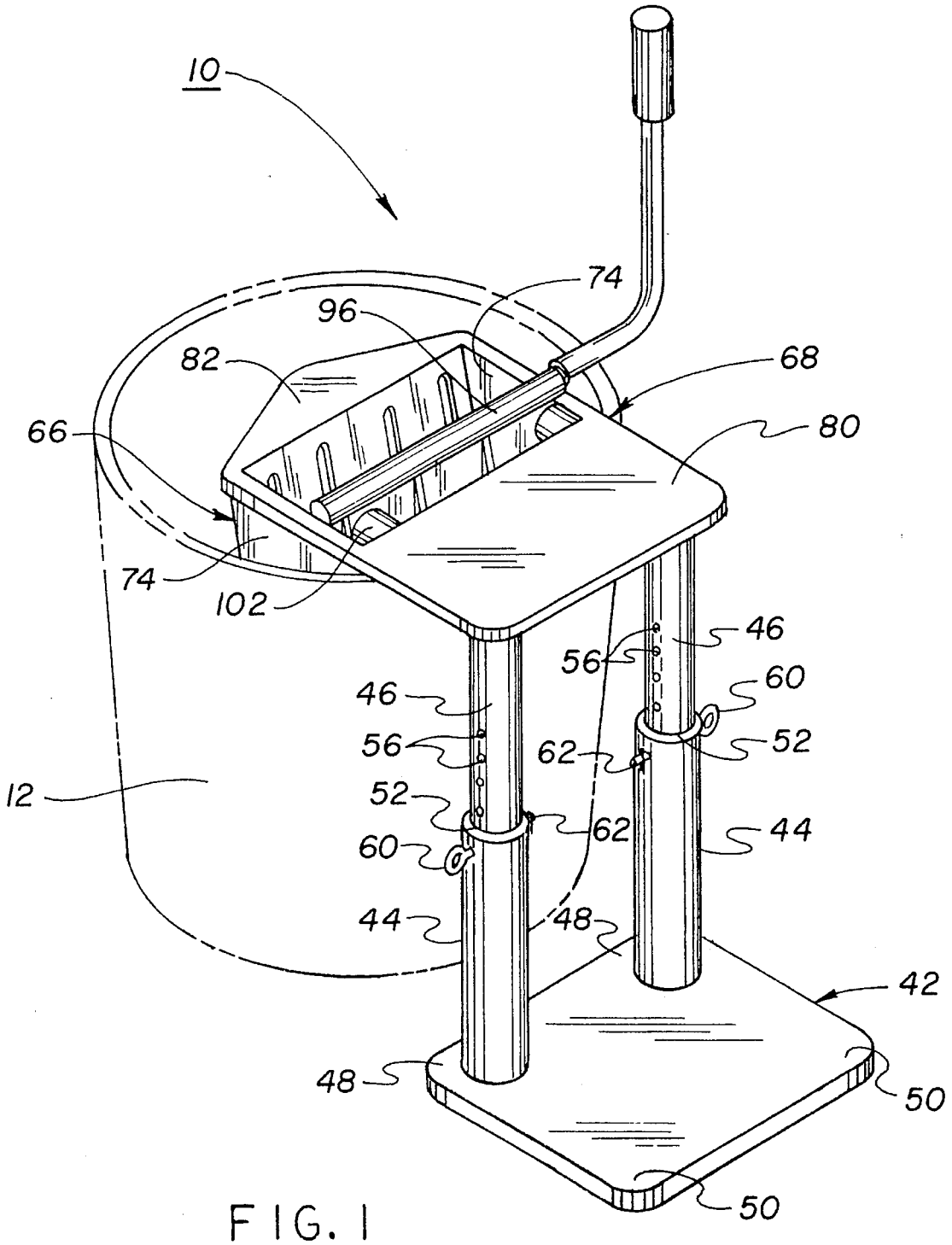
FIG. 1 is a perspective view of the preferred embodiment of the deck mop wringer with adjustable support stands constructed in accordance with the principles of the present invention.

With reference now to the drawings, and in particular to FIG. 1 thereof, the preferred embodiment of the new and improved deck mop wringer with adjustable support stands embodying the principles and concepts of the present invention and generally designated by the reference numeral 10 will be described.

The present invention, the deck mop wringer with adjustable support stands 10 is comprised of a plurality of components. Such components in their broadest context include a pail 12, a rear support stand 14, a front support stand 16, a wringer device 18 and a wringer plate assembly 20. Such components are individually configured and correlated with respect to each other so as to attain the desired objective.

More specifically, the pail 12 is formed in a generally cylindrical configuration with an open top. In the preferred embodiment the pail is fabricated of sturdy plastic materials. The pail includes cleaning fluid in an operative orientation. The cleaning fluid contains a combination of water and standard household cleanser. In the preferred embodiment the user will utilize the present invention with a floor mop. After scrubbing a floor a user will place the head of the mop in the apparatus and wring it out. The support stands clear the upper edge of the pail permitting the user to wring a mop without jostling the pail. Note FIG. 1.

Figure 8:
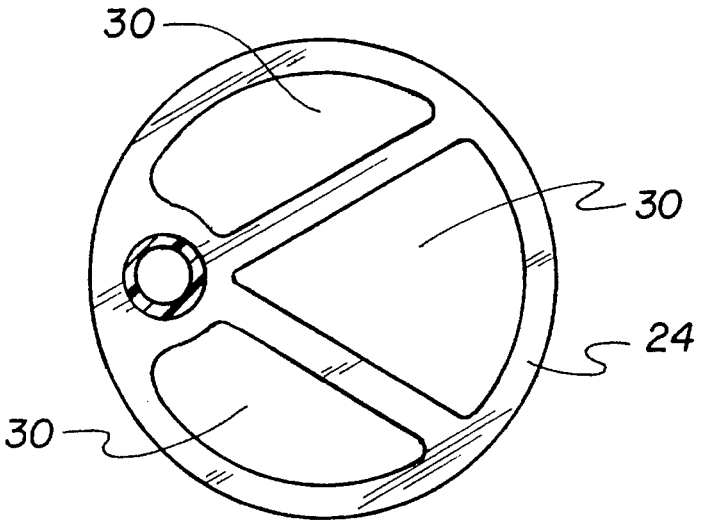
FIG. 8 is a perspective view of the rear support stand base of the apparatus.

A rear support stand 14 includes a circular base member 24, an upstanding receiving post 26 and an adjustable shaft 28. The circular base member is formed in a planar generally circular configuration with a plurality of large apertures 30 extending through it. The circular configuration of the base member permit easy placement within a cylindrical pail. The apertures in the base facilitate placement within a pail filled with fluid. When positioning the base member in the pail water will easily flow through and around the base member. Note FIGS. 1 and 8.

Figure 3:
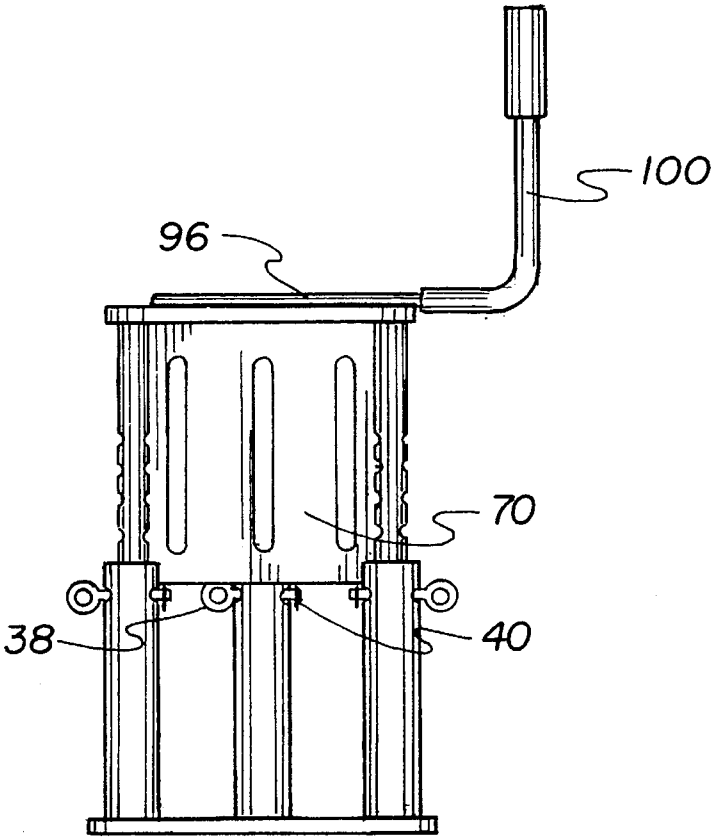
FIG. 3 is a rear elevational view of the deck mop wringer with adjustable support stands illustrating the positioning of the receiving posts and adjustable shafts of the apparatus.
Figure 5:
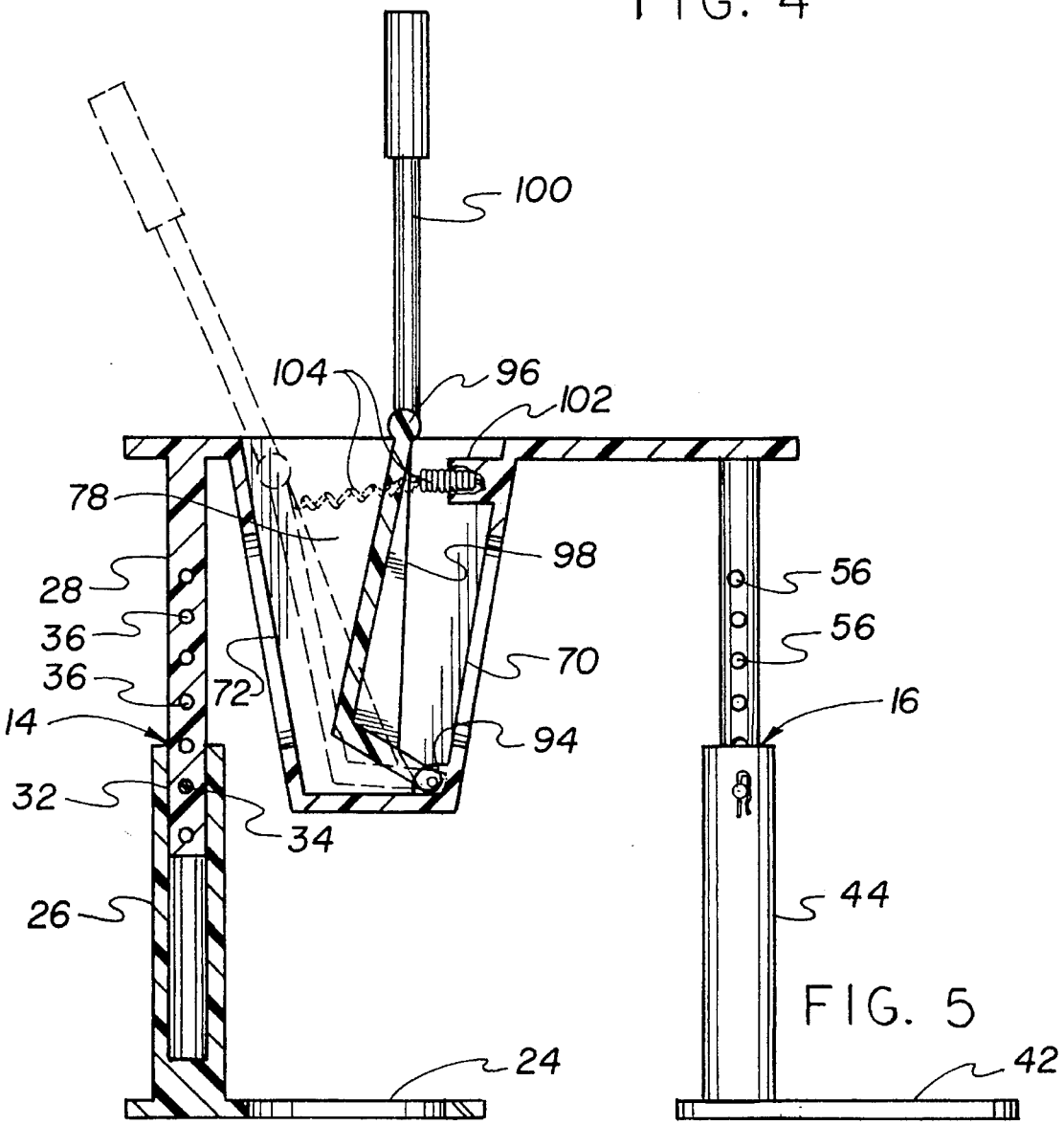
FIG. 5 is a cross sectional view taken along section line 5—5 of FIG. 4 and illustrating the positioning of the wringer plate assembly in different orientations.

The upstanding receiving post is affixed adjacent to the perimeter of the circular base member. The receiving post is formed in an elongated generally cylindrical configuration with an upper end and a lower end. The upper end includes an axially positioned bore 32 extending within it. The bore permits receipt of the adjustable shaft of the rear support stand. The receiving post includes a radially positioned aperture extending through it. Note FIGS. 3 and 5.

The adjustable shaft is formed in an elongated generally cylindrical configuration with an upper end, a lower end and a central region therebetween. The central region and lower end include a plurality of radially positioned apertures 36 extending through it. The lower end is adapted to be positioned in the bore of the receiving post. A pin 38 includes locking means 40 adapted to secure the adjustable shaft within the receiving post. The plurality of apertures in the receiving post enable the user to adjust the vertical height of the apparatus as desired. This configuration permits the user to raise the vertical height of the support stands to accommodate the varying heights of differently sized pails. The pin and associated locking means are easily removed from the support stand when height readjustment of the stand is desired. Note FIGS. 3 and 5.

A front support stand 16 includes a rectangular base member 42, two receiving posts 44 and two adjustable shafts 46. The base member is formed in a planar generally rectangular configuration with two rear corners 48 and two front corners 50. An upstanding receiving post is positioned upon each rear corner of the rectangular base member. The receiving posts are separated from each other by a distance sufficient to permit the positioning of a user's foot between them. When utilizing the apparatus, users first position a foot on the base member between the posts. The user then pulls the wringer assembly handle in a frontward direction to squeeze fluid from a mop head positioned in the bucket of the apparatus. Note FIGS. 1 and 3.

Figure 2:
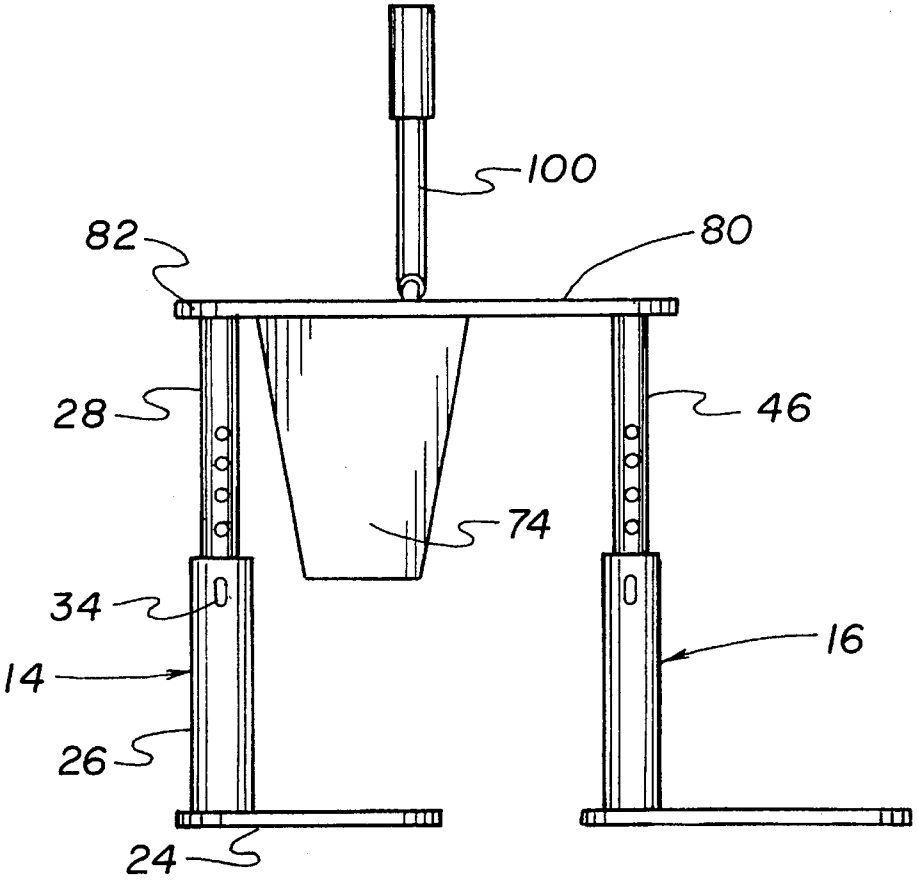
FIG. 2 is a side elevational view of the deck mop wringer with adjustable support stands.

Each receiving post is formed in an elongated generally cylindrical configuration with an upper end and a lower end. Each upper end includes an axially positioned bore 52 extending within it. Each receiving post includes a radially positioned aperture 54 extending through it. Each adjustable shaft 46 is formed in an elongated generally cylindrical configuration with an upper end, a lower end and a central region therebetween. Each central region and lower end include a plurality of radially positioned apertures 56 extending through them. Each lower end is adapted to be positioned in the bore of a receiving post. Note FIGS. 1–3.

Pins 60 including locking means 62 are adapted to secure each adjustable shaft within each receiving post. The pins are easily removed and replaced from the front support stand. The plurality of apertures enable the user to adjust the vertical height of the apparatus as desired. In an operative orientation the front and rear support stands will be adjusted to an equivalent vertical height. This vertical height will be higher than the pail being utilized with the apparatus. Note FIGS. 1–3.

Figure 4:
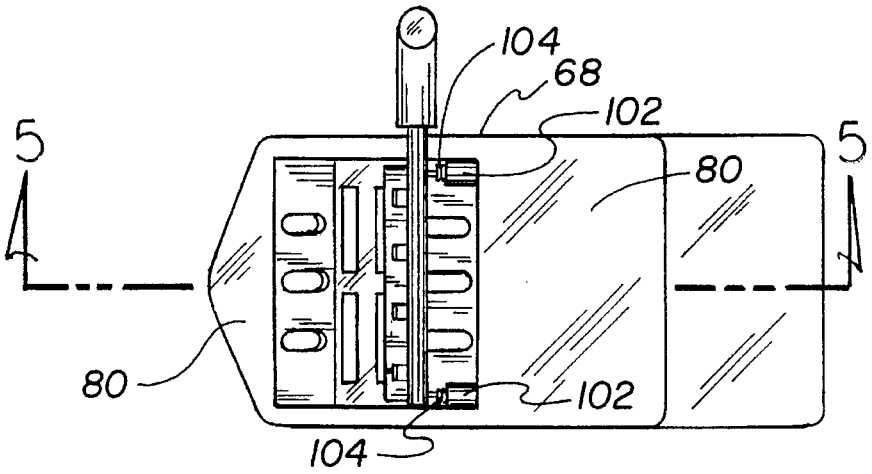
FIG. 4 is a top plan view of the deck mop wringer with adjustable support stands.

A wringer device 18 is comprised of a basket 66 and a rim 68. The basket is formed as a generally rectangular shaped box having a front wall 70, a rear wall 72, two side walls 74, a floor 76 and an open top 78. The front and rear walls include a plurality of elongated apertures and are angled outwardly from the floor to the open top. In the preferred embodiment the basket and associated rim are fabricated of metal. The open top is sufficiently wide and long to permit the easy placement of the head of a mop within it. The apertures in the front and rear walls of the basket permit the passage of water when wringing a mop head. Note FIGS. 3–5.

A rim 68 is positioned horizontally around the open top of the bucket. The rim has an upper surface and a lower surface and includes a frontwardly projecting ledge 80 formed in a generally planar rectangular configuration. The rim also includes a rearwardly projecting ledge 82 formed in a rounded generally triangular configuration. The rim includes an upper surface and a lower surface. The upper end of the adjustable shaft of the rear support stand is affixed to the lower surface of the rearwardly projecting ledge. The upper extent of each adjustable shaft of the front support stand is affixed to the lower surface of the frontwardly projecting ledge of the rim. In an operative orientation the bucket is positioned within the pail. The rim and the front ledge extend above and in front of the pail. This configuration prevents jostling of the pail when wringing a mop. Note FIGS. 1, 2 and 5.

Figure 6:
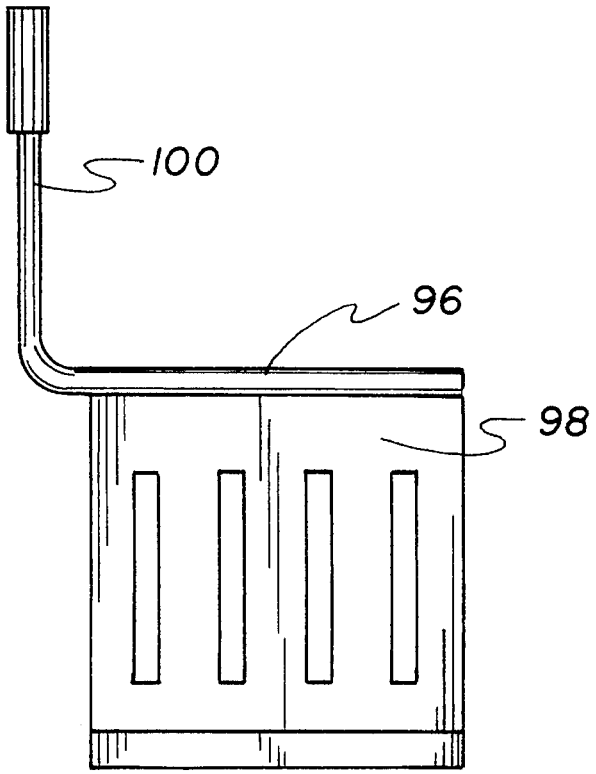
FIG. 6 is an isolated top plan view of the wringer plate assembly of the apparatus.
Figure 7:
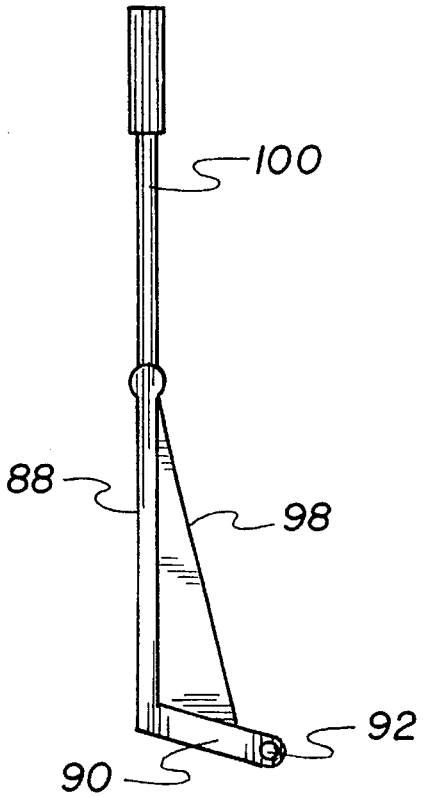
FIG. 7 is an isolated side plan view of the wringer plate assembly of the apparatus.

A wringer plate assembly 20 includes a generally L-shaped rear plate 86 with a long essentially vertical member 88 and a short essentially horizontal member 90. The horizontal member is formed in a planar rectangular configuration and includes a free end with rotatable coupling means 92. Hinges 94 are positioned in the front corners of the bucket adjacent to its floor. The free end of the horizontal member is rotatably coupled within the hinges. This configuration permits pivotable forward tilting of the plate to effect wringing of a mop head. The vertical member is formed in a planar rectangular configuration and has an upper extent including a cylindrical cross member 96. The vertical member includes a plurality of elongated apertures. The apertures permit passage of fluid from a mop head back into the associated pail. Note FIGS. 5–7.

A front plate 98 of the wringer plate assembly extends from the cylindrical cross member to the approximate centerpoint of the horizontal member. The front plate includes a plurality of elongated apertures to permit the passage of fluid through it. A handle 100 is formed in a generally L-shaped configuration with two free ends. One free end is pivotally coupled to an end of the cylindrical cross member. The handle includes a hand grip at its uppermost extent. The hand grip and L-shaped configuration of the handle permit a user to easily grasp and pull the handle to effect of wringing of a mop in an operative orientation. Note FIGS. 5 and 6.

Two cylindrical shaped spring base units 102 are positioned at the upper extent of the front wall of the wringer device. Resilient springs 104 extend from the spring base units and are coupled to the front plate of the wringer plate assembly. In an operative orientation the handle of the wringer plate assembly is pulled by the user to squeeze fluid out of a mop positioned in the bucket of the apparatus. The springs force the plate rearwardly when the handle is released. This feature resets the wringer plate for the next wringing operation. Note FIG. 5.

The deck mop wringer with adjustable support stands is a sturdy, lightweight household mop head wringer. This device provides equal balance and leverage for squeezing excess water out of a deck mop. The apparatus may be fabricated of light, durable plastic or metal. The present invention includes a wringer device with two L-shaped stands extending downward from each side. These stands provide a solid footing for the unit. Any standard pail can be used as long as the top edges can be cleared by the apparatus.

To use the apparatus the user places one of the stands inside the cleaning fluid filled plastic pail. The opposite stand remains outside the bucket and rests firmly on the ground. After soaking the mop head in the bucket, the operator inserts it into the wringer, and puts one foot on the outside support. This holds the apparatus securely in place while the user pulls or releases the wringer handle. Because the unit is not resting on the pail, but rather on its own support structure, there is little or no likelihood of it tipping or spilling. The container is strictly a basin or receptacle to hold the cleaning solution. Once the excess liquid has been squeezed from the mop, it can be lifted out and used again.

A deck mop can be much more efficient than a sponge version, but often requires ringing out by hand or with a cumbersome and heavy mechanism. This invention provides a convenient and reliable method to thoroughly clean a floor.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved deck mop wringer with adjustable support stands comprising, in combination:

a pail formed in a generally cylindrical configuration with an open top, the pail including cleaning fluid in an operative orientation;

a rear support stand including a circular base member, the circular base member being positioned horizontally and including a plurality of apertures, a receiving post formed in a cylindrical configuration with an upper extent including an axial bore and a radial aperture, the post being affixed vertically to the perimeter of the base member, an adjustable shaft formed in a cylindrical configuration and including a lower end with a plurality of radial apertures, the lower end being positionable in the bore of the receiving post, a pin including locking means securing the adjustable shaft within the receiving post at the desired vertical height;

a front support stand including a rectangular base member, the base member being positioned horizontally with two rear corners and two front corners, two receiving posts formed in a cylindrical configuration with an upper end including an axial bore and a radial aperture, the posts being affixed vertically to the rear corners of the base, two adjustable shafts formed in a cylindrical configuration with a lower end including a plurality of radial apertures, each lower end being positionable in the bore of a receiving post, a pin including locking means securing each adjustable shaft within a receiving post at the desired vertical height;

a wringer device comprising a basket and a rim, the basket being formed as a rectangular box having a front wall, a rear wall, two side walls, a floor and an open top, the front and rear walls including a plurality of apertures and being angled outwardly from the floor to the open top, hinges being positioned in the front corners of the basket adjacent to its floor, a rim with frontwardly and rearwardly projecting ledges being positioned horizontally around the open top of the basket, the adjustable shaft of the rear support stand being affixed to the rearwardly projecting ledge, the adjustable shaft of the front support stand being affixed to the frontwardly projecting ledge, the rear support stand and basket being positionable in the pail; and a wringer plate assembly including a generally L-shaped rear plate with a long vertical member and a short horizontal member, each member being formed in a planar rectangular configuration, the horizontal member including a free edge having rotatable coupling means and coupled within the hinges of the bucket, the vertical member having an upper extent including a cylindrical cross member and a plurality of apertures, a perforated front plate formed in a planar rectangular configuration and extending from the cylindrical cross member to the approximate centerpoint of the horizontal member, a handle formed in a generally L-shaped configuration with a free end pivotally coupled to the cylindrical cross member, two spring base units with resilient springs extending therefrom being affixed to the front wall of the basket, the springs being coupled to the front plate, a user pulling the handle to squeeze fluid from a mop positioned in the basket.

2. A deck mop wringer apparatus with adjustable support stands comprising:

a rear support stand including a base member and at least one vertically positioned shaft, each shaft being adjustably mounted to said base member such that said shaft can be moved to a plurality of different heights with respect to said base member;

a front support stand including a base member and at least one vertically positioned shaft, each shaft being adjustably mounted to said base member such that said shaft can be moved to a plurality of different heights with respect to said base member;

a wringer device comprising a basket and a rim, the basket having an open top, a floor and a plurality of side walls including apertures, the rim extending around and coupled to the open top of the basket, the shafts of the front and rear support stands being coupled to the rim to support the basket in a suspended orientation; and a wringer plate assembly including a perforated front plate and a handle, the plate being rotatably coupled within and to the basket and positioned in an essentially vertical orientation, the handle adapted to be pulled by a user to ring a mop head positioned within the basket.

3. The apparatus as set forth in claim 2 and further including:

a pail formed in a generally cylindrical configuration with an open top, the pail including cleaning fluid in an operative orientation, the rear support stand is received in said pail.

4. The apparatus as set forth in claim 2 wherein the rear support stand includes one adjustable shaft and the front support stand includes two adjustable shafts.

5. The apparatus as set forth in claim 2 wherein the base member of the rear plate is formed in a planar circular configuration and the base member of the front support stand is formed in a planar generally rectangular configuration.

6. The apparatus as set forth in claim 2 wherein the rim includes a frontwardly projecting ledge formed in an elongated generally rectangular configuration and a rearwardly projecting ledge formed in a rounded generally triangular configuration.

7. The apparatus as set forth in claim 2 and further including:

at least one resilient spring being coupled to one of said side walls of the basket and the front plate of the wringer plate assembly, the at least one spring biasing the plate toward said one side wall.

* * * * *